US006467898B2

(12) United States Patent
Codos et al.

(10) Patent No.: US 6,467,898 B2
(45) Date of Patent: Oct. 22, 2002

(54) METHOD AND APPARATUS FOR INK JET PRINTING ON TEXTILES

(75) Inventors: Richard N. Codos, Warren, NJ (US); William W. Collan, Freehold, NJ (US); Robert B. Comerford, Stewartsville, NJ (US); Angelo Quattrociocchi, Thornhill (CA); Milan Badovinac, Mississouga (CA)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/823,268

(22) Filed: Mar. 30, 2001

(65) Prior Publication Data

US 2001/0038408 A1 Nov. 8, 2001

Related U.S. Application Data

(63) Continuation-in-part of application No. 09/390,571, filed on Sep. 3, 1999, now Pat. No. 6,312,123, and a continuation-in-part of application No. PCT/US00/24226, filed on Sep. 1, 2000.

(51) Int. Cl.[7] ..... B41J 2/01; B41J 2/17

(52) U.S. Cl. ..... 347/102; 347/96; 347/101

(58) Field of Search ..... 347/96, 100, 101, 347/102; 399/251

(56) References Cited

U.S. PATENT DOCUMENTS

| | | | |
|---|---|---|---|
| 4,197,563 | A | 4/1980 | Michaud |
| 4,228,438 | A | 10/1980 | Vazirani |
| 4,266,229 | A | 5/1981 | Mansukhani |
| 4,271,347 | A | 6/1981 | Svenson |

(List continued on next page.)

FOREIGN PATENT DOCUMENTS

| | | |
|---|---|---|
| EP | 0080448 | 6/1983 |
| GB | 2322597 A | 9/1998 |

(List continued on next page.)

*Primary Examiner*—John Barlow
*Assistant Examiner*—An H. Do
(74) *Attorney, Agent, or Firm*—Wood, Herron & Evans, L.L.P.

(57) ABSTRACT

Ink jet printing is provided onto fabric using ultraviolet (UV) light curable ink. The ink is first partially cured with UV light and then is subjected to heating to more completely cure the ink and to remove by evaporation or otherwise, the uncured monomers and producing a printed image of ink having an amount of unpolymerized monomers and polymerization reactants and byproducts that is less than a food industry packaging standard of 100 PPM, and as low as 10 PPM. The printing is provided in a quilting machine having a quilting station and a printing station located upstream of the quilting station. Preferably, at the printing station, only a top layer of fabric is printed with a multi-colored design under the control of a programmed controller. UV curable ink is jetted onto the fabric with a dot volume of about 75 picoliters. A conveyor moves the printed fabric from the printing station through a UV curing station where a UV curing light head moves either with the print head or independent of the print head to expose the deposited drops of UV ink with a beam of about 300 watts per linear inch of energy, at a rate that applies about 1 joule per square centimeter. The conveyor then conveys the fabric through a heated drying station or oven where the fabric is heated to about 300° F. for from about 30 seconds up to about three minutes. Forced hot air is preferably used to apply the heat in the oven, but other heating methods such as infrared or other radiant heaters may be used. Before, or preferably after, the heat curing, the fabric is combined with other material layers and a quilted pattern is applied in program controlled coordination with the printed pattern.

22 Claims, 10 Drawing Sheets

U.S. PATENT DOCUMENTS

| | | | | |
|---|---|---|---|---|
| 4,303,924 | A | | 12/1981 | Young, Jr. |
| 4,408,400 | A | | 10/1983 | Colapinto |
| 4,551,925 | A | | 11/1985 | Ericsson |
| 4,836,102 | A | | 6/1989 | Cicci |
| 4,971,408 | A | | 11/1990 | Hoisington et al. |
| 5,396,275 | A | | 3/1995 | Koike et al. |
| 5,406,314 | A | | 4/1995 | Kuehnle |
| 5,409,504 | A | | 4/1995 | Fritzsche |
| 5,468,553 | A | | 11/1995 | Koike et al. |
| 5,500,023 | A | | 3/1996 | Koike et al. |
| 5,505,994 | A | | 4/1996 | Crawford |
| 5,526,742 | A | | 6/1996 | Petersen |
| 5,537,137 | A | | 7/1996 | Held et al. |
| 5,563,644 | A | | 10/1996 | Isganitis et al. |
| 5,621,449 | A | | 4/1997 | Leenders et al. |
| 5,623,001 | A | | 4/1997 | Figov |
| 5,680,168 | A | | 10/1997 | Kokubo et al. |
| 5,690,028 | A | | 11/1997 | Schick |
| 5,699,100 | A | | 12/1997 | Fukuda et al. |
| 5,745,140 | A | | 4/1998 | Stoffel et al. |
| 5,748,204 | A | | 5/1998 | Harrison |
| 5,764,262 | A | | 6/1998 | Wu et al. |
| 5,774,155 | A | | 6/1998 | Medin et al. |
| 5,858,514 | A | | 1/1999 | Bowers |
| 5,864,354 | A | | 1/1999 | Hibino |
| 5,873,315 | A | | 2/1999 | Codos |
| 6,092,890 | A | | 7/2000 | Wen et al. |
| 6,270,858 | B1 | * | 8/2001 | Paulson ..... 427/508 |
| 6,312,123 | B1 | * | 11/2001 | Codos et al. ..... 347/102 |

FOREIGN PATENT DOCUMENTS

| | | |
|---|---|---|
| JP | 61-164836 | 7/1986 |
| JP | 62092849 | 9/1987 |
| JP | 2-220883 | 9/1990 |
| JP | 7-66530 | 3/1995 |
| JP | 8-150707 | 6/1996 |
| JP | 8-218018 | 8/1996 |
| WO | WO 97/04964 | 2/1997 |
| WO | WO 97/42034 | 11/1997 |
| WO | WO 97/47481 | 12/1997 |

* cited by examiner

METHOD AND APPARATUS FOR INK JET PRINTING ON TEXTILES

This is a continuation in part of Ser. No. 09/390,571, filed Sep. 3, 1999 U.S. Pat. No. 6,312,123 and of International Application Serial No. PCT/US00/24226, filed Sep. 1, 2000, each commonly owned with the present application and each hereby expressly incorporated herein by reference.

FIELD OF THE INVENTION

The present invention relates to ink jet printing onto textiles, to the ink jet printing of wide web, large panel and other extended area substrates, and to the ink jet printing onto large area fabrics and other substrates on a high speed and commercial scale. The invention is particularly applicable to the printing of patterns onto fabric used in quilting such as mattress covers, comforters and bedspreads, and to the printing of signs, banners and other large area substrates. The invention is particularly related to the ink jet printing with ink compositions containing ultra-violet light (UV) curable and other polymerizable or otherwise stable inks.

BACKGROUND OF THE INVENTION

Needs have arisen for the printing of large banners, flags and signs in quantities that are not economical for many conventional printing processes. Proposals have been made to print such products from electronic source files that can be processed directly on the printing press or printing system, rather than through steps such as film image-setting and plate-making. One such process is that known as ink-jet printing. These processes have been attempted with modest success on surfaces such as vinyl, but printing with success onto textile surfaces has been even more limited. Such processes have been slow and lack reliability. The clogging of print heads in ink jet printing has been too frequent for use in wide width and large area substrates, and the processes used have not produced acceptable printing on textile materials.

Quilting, for example, is an art in which patterns are stitched through a plurality of layers of material over a two-dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. Frequently, a combining of stitched patterns with printed patterns is desirable, such as in mattress covers and other quilt manufacture. Producing a printed pattern on a mattress cover requires the application of ink to fabric, which, unlike paper, plastic or other smooth surfaces, presents a texture, third dimension or depth, to the surface on which the printing is applied.

The printing of substrates that are more than several feet, or a meter, wide, referred to as the special category of "wide width" printing, into which category the printing of mattress ticking and most other quiltable materials would fall, is beyond many of the limitations of conventional printing methods. A number of technical problems exist that have deterred the development of the printing of wide fabrics such as mattress covers, upholstery, automobile seat cover fabrics, office partitions and other wide width substrates.

Wide width products are frequently printed in relatively small quantities. Traditional printing typically involves the creation of a plate, a mat, a screen, or some other permanent or at least tangible, physical image from which ink is transferred to the object being printed. Such images contribute a relatively high set up cost that is only economical where the number of identical copies of the product is large. At the other extreme, office printers, for example, print a single copy or a small number of copies of a given document or other item, and are currently of the type that uses no permanent, physical image transfer element, but which rather prints from a software or program controlled electronic image, which can be changed from product to product. Such "soft" image printing is sometimes referred to as direct digital printing, although the "soft" image need not necessarily be "digital" in the sense of a set of stored discrete numerical values. Ink jet printers are a common type of such "soft" image or digital printers in use today.

Ink jet printers print by projecting drops of ink on demand onto a substrate from one or more nozzles on one or more print heads. Office printers and other narrow width ink jet printers usually dispense water based or other solvent based inks onto the substrate by heating the ink and exploding bubbles of the ink out of the nozzles. These printers are commonly called bubble jet printers. The ink dries by evaporation of the solvent. Sometimes additional heat is used to evaporate the solvent and dry the ink. Printing onto wide width substrates with bubble type ink jet printers, or ink jet printers that use high temperature techniques to propel the ink, severely limits the life of the print head. The heat used to expel the ink and the evaporation of the solvents, particularly during downtime, and the thermal cycling of the heads, causes these print heads to clog or otherwise fail after as little as 20 milliliters of ink is dispensed. Office printers are, for example, often designed so that the print head is replaced every time a reservoir of ink is replenished. For this reason, for larger scale ink jet printing processes, such as wide width printing of films used for outdoor advertising, signage and architectural applications, print heads that use mechanical ink propulsion techniques are more common. Such mechanical print heads include piezo or piezo-crystal print heads, which convert electrical energy into intra-crystal vibrations that cause drops of ink to be ejected from print head nozzles.

Piezo print heads are particularly useful for applying inks that dry by polymerization which can be brought about after the ink leaves the print head and is deposited onto the substrate, usually by exposure to some form of energy medium such as electromagnetic or particle radiation. Inks have been formulated for ink jet printing that can be polymerized by exposure to a radiation curing source such as a focused beam of ultra violet light (UV) or high energy beams of electrons (EB). The inks generally incorporate stabilizers which prevent premature curing due to low levels of light exposure. Therefore, the inks usually require exposure to some threshold level of energy that is necessary to initiate a polymerization reaction. Unless exposed to such threshold energy levels, such inks do not polymerize and remain stable, with a low tendency to dry in the nozzles or elsewhere unless cured by adequate exposure to the energy medium.

Solvent based inks are primarily cured by evaporation of the solvents. Some solvent based inks cure only by air drying, while others require the application of heat to enhance the evaporation of the solvent. In some cases, heat will facilitate a chemical change or polymerization of the ink along with an evaporation of a solvent. Polymerizable inks include monomers and oligomers that polymerize, and other additives. UV curable inks polymerize when exposed to UV light at or above the threshold energy level. These UV curable ink formulations include photoinitiators which absorb light and thereby produce free radicals or cations which induce crosslinking between the unsaturation sites of the monomers, oligomers and polymers, as well as other additive components. Electron beam-cured inks do not require photoinhibitors because the electrons are able to directly initiate crosslinking.

Heat or air curable inks that are organic solvent based or water based inks often do not have as high a color intensity as UV curable or other polymerizable inks because the pigments or dyes that produce the color are somewhat diluted by the solvent. Furthermore, organic solvents can produce an occupational hazard, requiring costly measures be taken to minimize contact of the evaporating solvents by workers and to minimize other risks such as the risks of fire. Solvent based inks, whether applied with heat or not, tend to dry out and eventually clog ink jet nozzles. In addition, solvent based inks set by forming a chemical bond with the substrate, and accordingly, their formulation is substrate material dependent. As a result, the selection of solvent based ink varies from fabric to fabric. Specific ink compositions are paired with specific fabric compositions to improve the fastness of the ink to the fabric, which results from chemical or electrostatic bonds formed between the ink and the fabric. Where the selected ink composition does not react or otherwise has an affinity with the surface of the particular fabric, the ink merely maintains a physical contact with the fabric surface and typically is easily removed by water, another solvent or abrasion. With UV and other radiant beam-curable inks such as electron beam-cured inks, the bonding between the ink and fabric is primarily mechanical and not limited to specific combinations of ink and fabric.

Polymerizable inks, particularly those cured upon exposure to a radiation or energy medium, are difficult to cure on three dimensional substrates such as the surface of a textile. While UV curable inks are capable of providing higher color intensity and do not present the hazards that many solvent based inks present and can avoid nozzle clogging, printing with UV curable ink onto textile fabric presents other problems that have not been solved in the prior art. To cure UV ink, for example, it must be possible to precisely focus a UV curing light onto the ink. UV ink, when jetted onto fabric, particularly onto highly textured fabric, is distributed at various depths over the texture of the fabric surface. Furthermore, the ink tends to soak into or wick into the fabric. As a result, the ink is present at various depths on the fabric, so that some of the ink at depths above or below the focal plane of the UV curing light evade the light needed to cause a total cure of the ink. In order to cure, UV ink must be exposed to UV light at an energy level above a curing threshold. However, increasing the intensity of the curing light beyond certain levels in order to enhance cure of the ink can burn, scorch or otherwise have destructive effects on the deposited ink or the fabric. Furthermore, ink jet printing can be carried out with different ink color dots applied in a side-by-side pattern or in a dot-on-dot (or drop-on-drop) pattern, with the dot-on-dot method being capable of producing a higher color density, but the higher density dot-on-dot pattern is even more difficult to cure when the cure is by UV light.

In addition, UV ink can be applied quickly to reduce wicking and UV ink can be developed to allow minimized wicking. Some wicking, however, helps to remove artifacts. Further, inks developed to eliminate wicking leave a stiff paint-like layer on the surface of the fabric, giving the fabric a stiff feel or "bad hand". Therefore, to reduce the UV curing problem by eliminating wicking is not desirable.

UV curing of jetted ink on fabric has a limited cure depth that is determined by the depth of field of the focused curing UV light. When UV curable ink is jetted onto fabric, UV light may proceed to cure an insufficient portion of the ink. A large uncured portion of the deposited ink can cause movement or loss of the ink over time, resulting in deterioration of the printed images. Even if a sufficient portion of the ink is cured to avoid visibly detectable effects, uncured ink at some level has the possibility of producing symptoms in some persons who contact the printed fabric. The amount of uncured monomers or ink components that can cause problems by inhalation or direct skin contact has not been officially determined, but standards exist for determining limits for components of packaging material ingested with food. For example, if more than approximately 100 parts per million (PPM) of ink from packaging material is present in food, some persons who are sensitive to the uncured monomers may suffer reactions and others may develop sensitivities to the material. Such criteria assumes that 1 square inch of packaging material makes contact with ten grams of food. Thus, to interpret this criteria, it is assumed that each PPM of ink component in packaged food is equivalent to 15.5 milligrams of ink component migrating out of each square meter of packaging material into the food. While this does not provide an exact measure of the amount of uncured ink components that might be harmful to humans, it suggests that approximately 10% of uncured ink components on items of clothing, mattress covers or other fabrics with which persons may be in contact for extended periods of time, may be unacceptable.

For the reasons stated above, UV curable inks have not been successfully used to print onto fabric where a high degree of cure is required. Heat curable or other solvent based inks that dry by evaporation can be cured on fabric. As a result, the ink jet printing of solvent based inks and heat curable or air dryable solvent based ink has been the primary process used to print on fabric. Accordingly, the advantages of UV or other radiation curable ink jet printing have not been available for printing onto fabric.

There exists a need in printing of patterns onto mattress ticking and mattress cover quilts, as well as onto other types of fabrics, for a process to bring about an effective cure of ink compositions containing UV curable inks and to render practical the printing with UV curable inks onto fabric.

SUMMARY OF THE INVENTION

An objective of the present invention is to provide an effective method and apparatus for wide width "digital" or "soft" image printing onto textile fabric. Another objective of the invention is to effectively apply a stable curable ink onto a textile or other substrate and to effectively cure the ink on the substrate with UV other energy, a chemical curing agent or other curing medium, and particularly doing so using ink jet printing. A further objective of the invention is to successfully apply and effectively cure ink jetted onto textiles and other substrates in a reliable manner without a tendency of the nozzles of the heads to frequently clog. Particularly, it is an objective of the invention to print onto textile fabrics and wide width substrates with a piezo or other mechanical or electro-mechanical print head.

Another objective of the invention is to provide for the printing onto textile fabric and other textured or wide width substrates using an ink that remains stable until deposited onto the surface of the substrate. A particular objective is to provide such a process for printing with UV ink or other inks that are curable by exposure to impinging energy. A particular objective of the invention is to provide for the effective curing of UV inks jetted onto fabric by reducing uncured monomers and other extractable non-solvent polymerization reactants, including reactant byproducts, or components of the ink, to a level most likely to be tolerable by or acceptable to persons contacting the printed substrates.

According to the principles of the present invention, a stable ink is digitally printed onto fabric and setting of the ink is initiated after the ink is deposited onto the substrate. In the preferred embodiment, stable UV ink monomers are deposited onto the substrate and polymerization of the ink is initiated by exposure to an impinged energy beam, such as UV, EB or other such energy beam. In accordance with certain aspects of the invention, the UV exposed or otherwise polymerization initiated ink is thereafter subjected to heat to reduce the content in the ink of unpolymerized polymerizable reactants and other extractable components of the ink to low levels that are likely to be tolerable or otherwise acceptable to persons contacting the fabric.

According to other embodiments of the invention, stable dye components can be added to the otherwise polymerizable ink to form a stable composition. The composition is digitally printed onto the substrate, whereupon the dye component is brought into contact with fiber surfaces in the fabric to chemically bond or form an affinity with those surfaces. Polymerization of the UV or other curable ink component is initiated by exposure to an impinged energy beam, such as UV, EB or other such energy beam. This effects at least a surface cure of the UV or other curable ink component, but generally has little effect on the dye component. Then the partially polymerized or cured ink is thereafter subjected to heat to both complete chemical bonding of the dye or finalizing formation of an affinity to the fiber surfaces and reduce the unpolymerized polymerizable reactants and other extractable components of the UV or other curable ink component to low levels that are likely to be tolerable or otherwise acceptable to persons contacting the fabric. Further, the invention provides for an ink composition which contains, in combination with the UV ink or other inks curable by exposure to impinging energy, one or more dyes which are both reactive or have an affinity to some or all of the fiber surfaces of the fabric and are compatible with the UV or other curable ink. The UV inks or other inks curable by exposure to impinging energy are comprised of a polymerizable portion and at least one pigment, suspended in the polymerizable portion. The ink composition incorporates a separate dye component which is combined with the UV or other impinging energy curable ink. The dye portion of such ink compositions is selected from the group including, but not limited to, disperse dyes, reactive dyes, acid dyes, basic dyes, metallized dyes, naphthol dyes and other dyes which do not require a post-treatment to either set the dye or to develop the color. Disperse dyes are widely used for dyeing most manufactured fibers. Reactive dyes are anionic dyes which react with hydroxyl groups in cellulose fibers in the presence of alkali. Acid dyes are used on wool and other animal fibers, as well as certain manufactured fibers such as nylon. Basic dyes are positive-ion-carrying dyes which have a direct affinity for wool and silk. these dyes may also be used on basic-dyeable acrylics, modacrylics, nylons, and polyesters. Naphthol dyes are formed on the fiber by first treating the fiber with a phenolic compound in caustic solution and then applying a solution of a diazonium salt. the salt reacts with the phenolic compound to produce a colored azo compound. Generally, these dyes are used for cellulose fibers.

In certain embodiments of the invention, a stable ink composition is jetted onto fabric and the set or cure of the ink is initiated by exposure to a chemical substance, energy or otherwise after it is ejected from the ink jet nozzles. In the preferred and illustrated embodiments, UV polymerizable ink is jetted onto the substrate where it is exposed to UV light for its cure. Preferably, a non-bubble jet print head such as a piezo-crystal or other mechanical ink ejection transducer is used to jet the ink. Heat may be applied to the piezo-crystal or other mechanical ink injection transducer during operation, but generally only to the extent necessary for ink viscosity reduction. With or following the exposure to the UV light, the printed fabric is subjected to a heated air stream which either extends the UV light initiated curing process, drives off uncured components of the ink, or both. More particularly, UV curable ink is jetted onto the fabric, and the jetted ink is exposed to UV curing light to cure the UV ink component to an extent sufficient to render the printed image substantially resistant to further wicking, which is generally about 60 to 95% polymerization depending on ink density, substrate porosity and composition, and substrate weight and thickness. Then, the fabric bearing the partially cured jetted ink is heated with heated air in a heat curing oven, at which the UV light initiated polymerization may continue, or uncured monomers are vaporized, or both, in order to produce a printed image of UV ink that contains a reduced level of uncured monomers or other components of the ink which is likely to be tolerable by persons sensitive or potentially sensitive to such ink components. Where dye is included in the ink, the presence of heat facilitates chemical bonding or affinity formation of unreacted dye in contact with fiber surfaces in the fabric. Preferably, the uncured components of the ink are reduced to an order of magnitude of about a gram per square meter, for example, and generally not more than about 1.55 grams per square meter of uncured monomer on the fabric substrate. To the extent that a dye component is included which does not bind chemically to the fiber surfaces or form an affinity, the portion of dye which does not react with the surfaces is encapsulated within the polymerized UV ink composition to minimize migration of the dye. This encapsulation effect reduces or eliminates the need for post-treatment to remove the mobile dye from the fabric.

According to the preferred embodiment of the invention, ink is jetted onto a highly textured fabric such as a mattress cover ticking material, preferably prior to the quilting of the fabric into a mattress cover. The ink is jetted at a dot density of about 180×256 dots per inch per color to about 300×300 dots per inch per color, though lower dot densities of from about 90×256 dots per inch can be applied. Preferably, four colors of a CMYK color palette are applied, each in drops or dots of about 75 picoliters, or approximately 80 nanograms, per drop, utilizing a UV ink jet print head. A UV curing light head is provided, which moves either with the print head or independent of the print head and exposes the deposited drops of UV ink with a beam of about 300 watts per linear inch, applying about 1 joule per square centimeter. Generally, UV ink will begin to cure, at least on the surface, at low levels of energy in the range of about 20 or 30 millijoules per square centimeter. However, to effect curing in commercial operation, higher UV intensities in the range of about 1 joule per square centimeter are desired. Provided that some minimal threshold level of energy density is achieved, which can vary based on the formulation of the ink, the energy of the beam can be varied as a function of fabric speed relative to the light head and the sensitivity of the fabric to damage from the energy of the beam. The fabric on which the jetted ink has been thereby partially UV cured is then passed through an oven where it is heated to about 300° F. for from about 30 seconds up to about three minutes. Forced hot air is preferably used to apply the heat in the oven, but other heating methods such as infrared or other radiant heaters may be used. The UV energy level, oven heating temperature and oven heat time may be varied within a range of the above listed values depending on the nature of the fabric, the density, type and composition of the applied ink; and the speed of the fabric during processing relative to the UV curing light head. Thus, a higher ink density applied to the fabric will generally require more UV energy, higher oven heating temperature, longer oven heat time or a combination of these variables, to effect the necessary curing on the particular fabric. Further, the amount of heat needed to cause reaction or form an affinity of the dye component, when included, with the fiber surface of the fabric is a function of at least the dye component concentration, dye chemical composition, fiber composition, and fabric processing speed past or through the heat source. Generally, the upper limits for the UV or other impinging beam of energy and oven heating temperature are those values which, when applied to the specific ink and fabric, begin to damage or otherwise adversely affect the applied ink, the underlying fabric or both.

The invention has the advantage that, for different inks and using different criteria for the desired residual amount of uncured ink components remaining on the fabric, the parameters can be varied to increase or reduce the residual amount. By increasing or decreasing the intensity of energy, or using a different form of energy than UV, or by increasing or decreasing the time of exposure of the ink to the energy, the amount of remaining unpolymerized non-solvent ink components can be changed. Additionally, using higher or lower temperatures, or more or less air flow, or greater or less heating time in the post curing oven, can change the final composition of the ink on the substrate. Care, however, should be taken that the energy curing or heating process does not damage the fabric or the ink.

A further advantage of the invention is that a portion of the ink composition can be included that will combine with fiber surfaces to provide coloration which is chemically bonded or has an affinity to those surfaces. Color or wash fastness due to chemical reaction or affinity formation of the dye to fiber surfaces over at least a portion of the printed fabric is accomplished while maintaining the advantage of mechanical bonding of the UV ink component onto other portions of the fiber.

The invention makes it possible to print images on fabric with UV curable ink by providing effective curing of the ink, leaving less than a nominal 1.55 grams of uncured monomers per square meter of printed material and usually leaving only about 0.155 grams per square meter of uncured monomers. Thus, the invention provides the benefits of using UV curable ink over water and solvent based inks, including the advantages of high color saturation potential, low potential sensitivity or toxicity, and without clogging the jet nozzles and enabling the use of piezo or other high longevity print heads. Furthermore, the encapsulation effect provided by the cured UV ink substantially or completely prevents migration of non-binding dye, if included, onto other sections of the fabric, or onto other fabrics as in the case of washing the printed fabric with other items. Furthermore, the ability to print on wide width fabrics with polymerizable inks, which do not form chemical bonds with the substrates, and therefore are not material dependent, provides an advantage, particularly with fabrics such as mattress covers and other furniture and bedding products.

These and other objects of the present invention will be more readily apparent from the following detailed description of the preferred embodiments of the invention.

DETAILED DESCRIPTION OF THE PREFERRED EMBODIMENT

Figure 1:
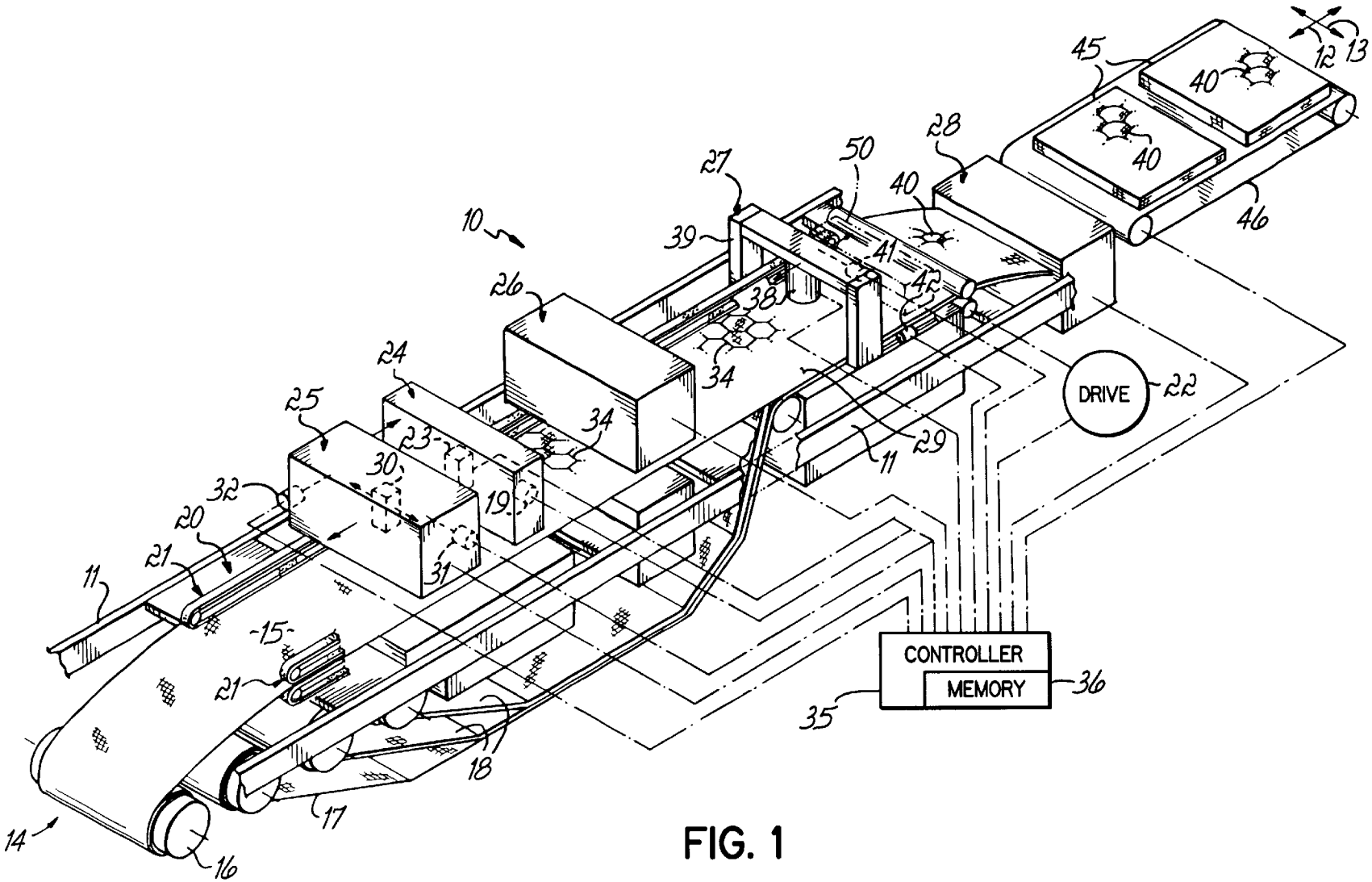
FIG. 1 is a diagrammatic perspective view of a one embodiment of a web-fed mattress cover printing and quilting machine embodying principles of the present invention.

The figure illustrates a quilting machine 10 having a stationary frame 11 with a longitudinal extent represented by an arrow 12 and a transverse extent represented by an arrow 13. The machine 10 has a front end 14 into which is advanced a web 15 of ticking or facing material from a supply roll 16 rotatably mounted to the frame 11. A roll of backing material 17 and one or more rolls of filler material 18 are also supplied in web form on rolls also rotatably mounted to the frame 11. The webs are directed around a plurality of rollers (not shown) onto a conveyor or conveyor system 20, each at various points along the conveyor 20. The conveyor system 20 preferably includes a pair of opposed pin tentering belt sets 21 which extend through the machine 10 and onto which the outer layer 15 is fed at the front end 14 of the machine 10. The belt sets 21 retain the web 15 in a precisely known longitudinal position thereon as the belt sets 21 carry the web 15 through the longitudinal extent of the machine 10, preferably with an accuracy of 0 to ¼ inch. The longitudinal movement of the belts 21 is controlled by a conveyor drive 22. The conveyor 20 may take alternative forms including, but not limited to, opposed cog belt side securements, longitudinally moveable positive side clamps that engage and tension the material of the web 15 or other securing structure for holding the facing material web 15 fixed relative to the conveyor 20.

Along the conveyor 20 are provided three stations, including an ink jet printing station 25, a UV light curing station 24, a heated drying station 26, a quilting station 27 and a panel cutting station 28. The backing material 17 and filler material 18 are brought into contact with the top layer 15 between the drying station 26 and the quilting station 27 to form a multi-layered material 29 for quilting at the quilting station 27. Preferably, the layers 17,18 are not engaged by the belt sets 21 of the conveyor 20, but rather, are brought into contact with the bottom of the web 15 upstream of the quilting station 27 to extend beneath the web 15 through the quilting station 27 and between a pair of pinch rollers 44 at the downstream end of the quilting station 27. The rollers 44 operate in synchronism with the belt sets 21 and pull the webs 17,18 through the machine 10 with the web 15.

The printing station 25 includes one or more ink jet printing heads 30 that are transversely moveable across the frame 11 and may also be longitudinally moveable on the frame 11 under the power of a transverse drive 31 and an optional longitudinal drive 32. Alternatively, the head 30 may extend across the width of the web 15 and be configured to print an entire transverse line of points simultaneously onto the web 15.

The ink jet printing head 30 is configured to jet UV ink at 75 picoliters, or approximately 80 nanograms, per drop, and to do so for each of four colors according to a CMYK color pallette. Preferably, the printing head 30 does not undergo a heating step during operation. A mechanical or electro-mechanical print head such as a piezo print head is preferred. The dots are preferably dispensed at a resolution of about 180 dots per inch by about 256 dots per inch. The resolution may be higher or lower as desired, but the 180×256 resolution is preferred. If desirable for finer images or greater color saturation, 300×300 dots per inch is preferable. The drops of the different colors can be side-by-side or dot-on-dot. Dot-on-dot (sometimes referred to as drop-on-drop) produces higher density.

The print head 30 is provided with controls that allow for the selective operation of the head 30 to selectively print two-dimensional designs 34 of one or more colors onto the top layer web 15. The drive 22 for the conveyor 20, the drives 31,32 for the print head 30 and the operation of the print head 30 are program controlled to print patterns at known locations on the web 15 by a controller 35, which includes a memory 36 for storing programmed patterns, machine control programs and real time data regarding the nature and longitudinal and transverse location of printed designs on the web 15 and the relative longitudinal position of the web 15 in the machine 10.

The UV curing station 24 includes a UV light curing head 23 that may move with the print head 30 or, as is illustrated, move independently of the print head 30. The UV light curing head 23 is configured to sharply focus a narrow longitudinally extending beam of UV light onto the printed surface of the fabric. The head 23 is provided with a transverse drive 19 which is controlled to transversely scan the printed surface of the fabric to move the light beam across the fabric. Preferably, the head 23 is intelligently controlled by the controller 35 to selectively operate and quickly move across areas having no printing and to scan only the printed images with UV light at a rate sufficiently slow to UV cure the ink, thereby avoiding wasting time and UV energy scanning unprinted areas. If the head 23 is included in the printing station 25 and is coupled to move with the print head 30, UV curing light can be used in synchronism with the dispensing of the ink immediately following the dispensing of the ink.

The UV curing station 24, in the illustrated embodiment, is located immediately downstream of the printing station 25 so that the fabric, immediately following printing, is subjected to a UV light cure. In theory, one photon of UV light is required to cure one free radical of ink monomer so as to set the ink. In practice, one joule of UV light energy is supplied by the UV curing head 23 per square centimeter of printed surface area. This is achieved by sweeping a UV beam across the printed area of the fabric at a power of 300 watts per linear inch of beam width and exposing the surface for a time sufficient to deliver the energy at the desired density. Alternatively, if fabric thickness and opacity are not too high, curing light can be projected from both sides of the fabric to enhance the curing of the UV ink. Using power much higher can result in the burning or even combustion of the fabric, so UV power has an upper practical limit.

The heat curing or drying station 26 is fixed to the frame 11, preferably immediately downstream of the UV light curing station. With sufficient UV cure to stabilize the ink such that the printed image is substantially resistant to further wicking, the ink will be sufficiently color-fast so as to permit the drying station to be off-line, or downstream of the quilting station 27. In embodiments in which a dye component is included in the ink composition, the dye will have either reacted or formed an affinity with certain fiber surfaces, or will have become substantially or completely encapsulated within the cured UV in component. When on-line, the drying station should extend sufficiently along the length of fabric to adequately cure the printed ink at the rate that the fabric is printed. Heat cure at the oven or drying station 26 maintains the temperature of the ink on the fabric at about 300° F. for up to three minutes. Heating of from 30 seconds to 3 minutes is the anticipated acceptable range. Heating by forced hot air is preferred, although other heat sources, such as infrared heaters, can be used as long as they adequately penetrate the fabric to the depth of the ink.

The exact percentage of tolerable uncured monomers varies from ink to ink and product to product. Generally, it is thought that uncured monomers of UV curable ink should be reduced to below about 0.1%, or 1000 PPM. In the preferred embodiment of the invention, uncured monomers of UV curable ink are reduced to less than 100 PPM, and preferably to about 10 PPM. As explained above, each 1 PPM is equivalent to about 15.5 milligrams extractables per square meter of printed material. As used herein, the percentage or portion of remaining uncured monomers refers to the mass of extractable material that can be removed from a given sample of cured ink by immersing the cured ink sample in an aggressive solvent such as toluene, and measuring the amount of material in the solvent that is removed from the ink by the solvent. The measurements are made with a gas chromatograph with a mass detector. In the preferred embodiment of the invention, the measured amount of material removed from a given sample of the ink is less than 1.5 grams extractables per square meter of printed material. Measurements of higher than 100 PPM or 1.5 grams extractables per square meter of printed material are undesirable. Measurements of 10 PPM are preferred.

In certain specialized embodiments, an ink composition comprising a UV ink component and a dye component may be formulated in a manner which generates a compatible, shelf-stable composition. The relative concentration ranges of UV ink component to dye component in such compositions will vary with the nature of the fabric being printed, and the respective physical characteristics of the UV ink and dye components. Non-limiting physical characteristics of the UV ink and dye which are evaluated in connection with enhancing compatibility of the UV ink component with the dye component include polarity, viscosity, and pH. The dye and UV ink would be selected so that no reaction occurs or can be expected to occur between these ink components or with any other incorporated additive under the conditions expected during storage and printing operation.

The quilting station 27 is located downstream of the oven 26 in the preferred embodiment. Preferably, a single needle quilting station such as is described in U.S. patent application Ser. No. 08/831,060 to Jeff Kaetterhenry, et al. and entitled Web-fed Chain-stitch Single-needle Mattress Cover Quilter with Needle Deflection Compensation, which is expressly incorporated by reference herein, now U.S. Pat. No. 5,832,849. Other suitable single needle type quilting machines with which the present invention may be used are disclosed in U.S. patent applications Ser. Nos. 08/497,727 and 08/687,225, both entitled Quilting Method and Apparatus, expressly incorporated by reference herein, now U.S. Pat. Nos. 5,640,916 and 5,685,250, respectively. The quilting station 27 may also include a multi-needle quilting structure such as that disclosed in U.S. Pat. No. 5,154,130, also expressly incorporated by reference herein. In the figure, a single needle quilting head 38 is illustrated which is transversely moveable on a carriage 39 which is longitudinally moveable on the frame 11 so that the head 38 can stitch 360° patterns on the multi-layered material 29.

The controller 35 controls the relative position of the head 38 relative to the multi-layered material 29, which is maintained at a precisely known position by the operation of the drive 22 and conveyor 20 by the controller 35 and through the storage of positioning information in the memory 36 of the controller 35. In the quilting station 27, the quilting head 38 quilts a stitched pattern in registration with the printed pattern 34 to produce a combined or composite printed and quilted pattern 40 on the multi-layered web 29. This may be achieved, as in the illustrated embodiment by holding the assembled web 29 stationary in the quilting station 27 while the head 38 moves, on the frame 11, both transversely under the power of a transverse linear servo drive 41, and longitudinally under the power of a longitudinal servo drive 42, to stitch the 360° pattern by driving the servos 41,42 in relation to the known position of the pattern 34 by the controller 35 based on information in its memory 36. Alternatively, the needles of a single or multi-needle quilting head may be moved relative to the web 29 by moving the quilting head 38 only transversely relative to the frame 11 while moving the web 29 longitudinally relative to the quilting station 27, under the power of conveyor drive 22, which can be made to reversibly operate the conveyor 20 under the control of the controller 35.

In certain applications, the order of the printing and quilting stations 25,27, respectively, can be reversed, with the printing station 25 located downstream of the quilting station 27, for example the station 50 as illustrated by phantom lines in the figure. When at the station 50, the printing is registered with the quilting previously applied at the quilting station 27. In such an arrangement, the function of the curing station 26 would also be relocated to a point downstream of both the quilting station 27 and printing station 50 or be included in the printing station 50, as illustrated.

The cutoff station 28 is located downstream of the downstream end of the conveyor 20. The cutoff station 28 is also controlled by the controller 35 in synchronism with the quilting station 27 and the conveyor 20, and it may be controlled in a manner that will compensate for shrinkage of the multi-layered material web 29 during quilting at the quilting station 27, or in such other manner as described and illustrated in U.S. Pat. No. 5,544,599 entitled Program Controlled Quilter and Panel Cutter System with Automatic Shrinkage Compensation, hereby expressly incorporated by reference herein. Information regarding the shrinkage of the fabric during quilting, which is due to the gathering of material that results when thick, filled multi-layer material is quilted, can be taken into account by the controller 35 when quilting in registration with the printed pattern 34. The panel cutter 28 separates individual printed and quilted panels 45 from the web 38, each bearing a composite printed and quilted pattern 40. The cut panels 45 are removed from the output end of the machine by an outfeed conveyor 46, which also operates under the control of the controller 35.

Piezo print heads useful for this process are made by Spectra of New Hampshire. UV curing heads useful for this process are made by Fusion UV Systems, Inc., Gaithersburg, Md.

Figure 2:
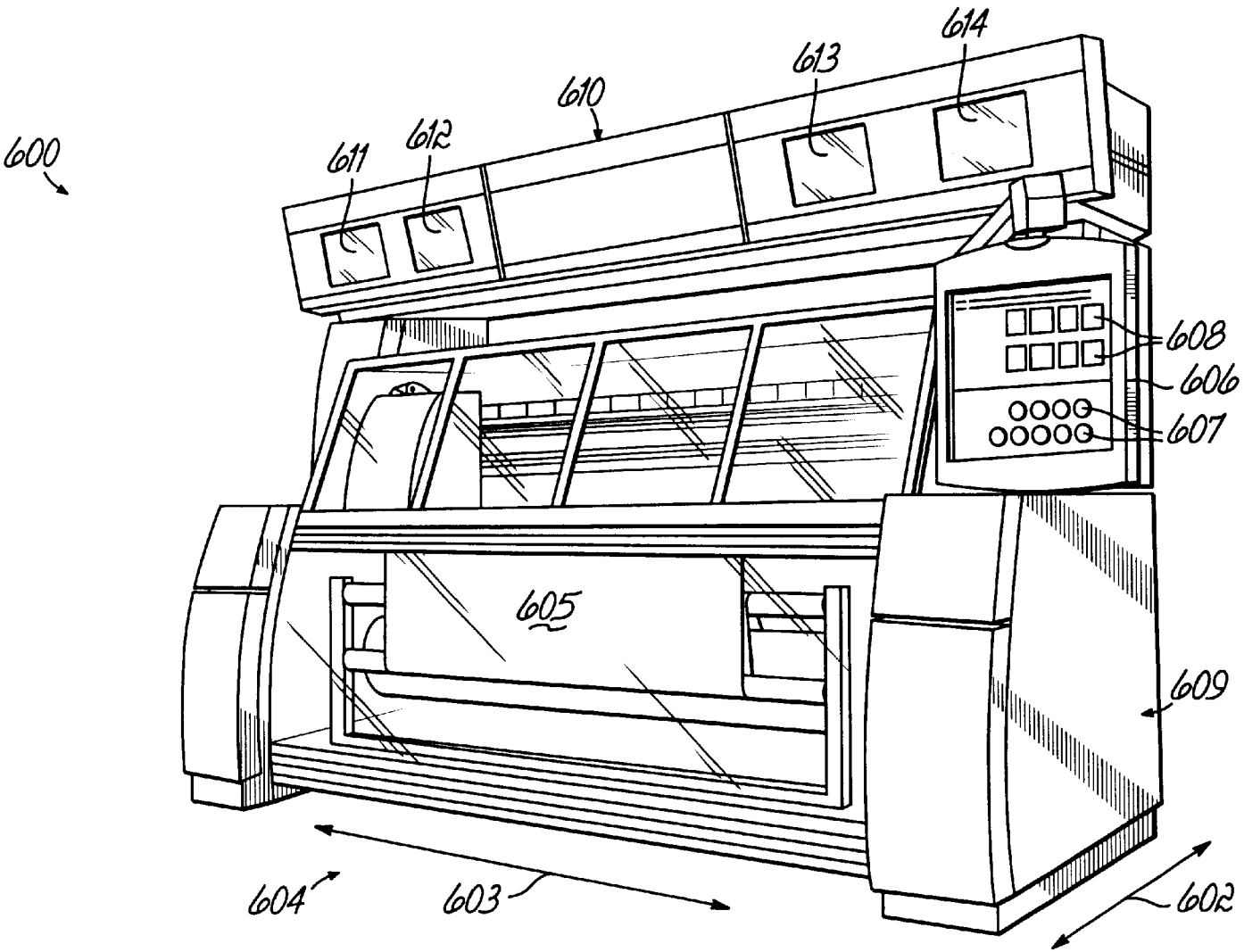
FIG. 2 is a perspective view of an ink jet printing machine embodying principles of the present invention.

An alternative embodiment of the invention is the ink jet printing machine 600 illustrated in FIG. 2. The machine 600 is a roll-to-roll ink jet printing machine that is particularly configured for printing onto wide textile webs. Such machines are particularly useful for printing a facing layer of material which may then be transferred to a quilting machine on a separate quilting line or to feed material downstream to a quilting station as in the embodiment illustrated in FIG. 1, described above. The machine 600 is also particularly suited to print on textiles that are not necessarily to be used in a quilted product, such as for signs, banners, apparel and other products.

The printing machine 600 has a stationary housing 601 with a longitudinal extent represented by arrow 602 and a transverse extent represented by arrow 603. The machine 600 has a front end 604 from which is advanced a substrate web of textile material 605 downstream in the longitudinal direction. The material may be a greige goods textile material or some other material on which printing is desired. Where the material is a textile, it can have been preconditioned by precoating, shaving or singeing of the surface to be printed to eliminate dust and lint that could collect on the print heads and potentially contribute to clogging of the nozzles. Failure to remove the fuzz can cause the fuzz or dust to be sucked into the nozzle orifices as the flow reverses between dot ejections, which could clog the nozzles.

An operator station 606 is provided at the right side of the front end of the housing 601 having a push button control panel 607 and a touch screen and display 608. The housing 601 includes a base assembly 609 which supports the machine 600 and encloses the supply of substrate material as described in connection with FIG. 3 below. Across the top of the housing 601 transversely and supported on the base 609 extends an information bridge 610. The information bridge 610 has four display screens 611–614 facing the front 604 of the machine 600. From the control panel 606 an operator can select the information to be displayed on each of the screens 611–614. Such information can include status data, machine parameter settings, scheduling, batch and product information, pattern data, machine status and alarm conditions, or other information useful in operating the machine. One or more of the screens 611–614 can also be set to display video images of the printing area or the substrate downstream of the printing station from information captured by video cameras (not shown) mounted on the machine 600.

Figure 3:
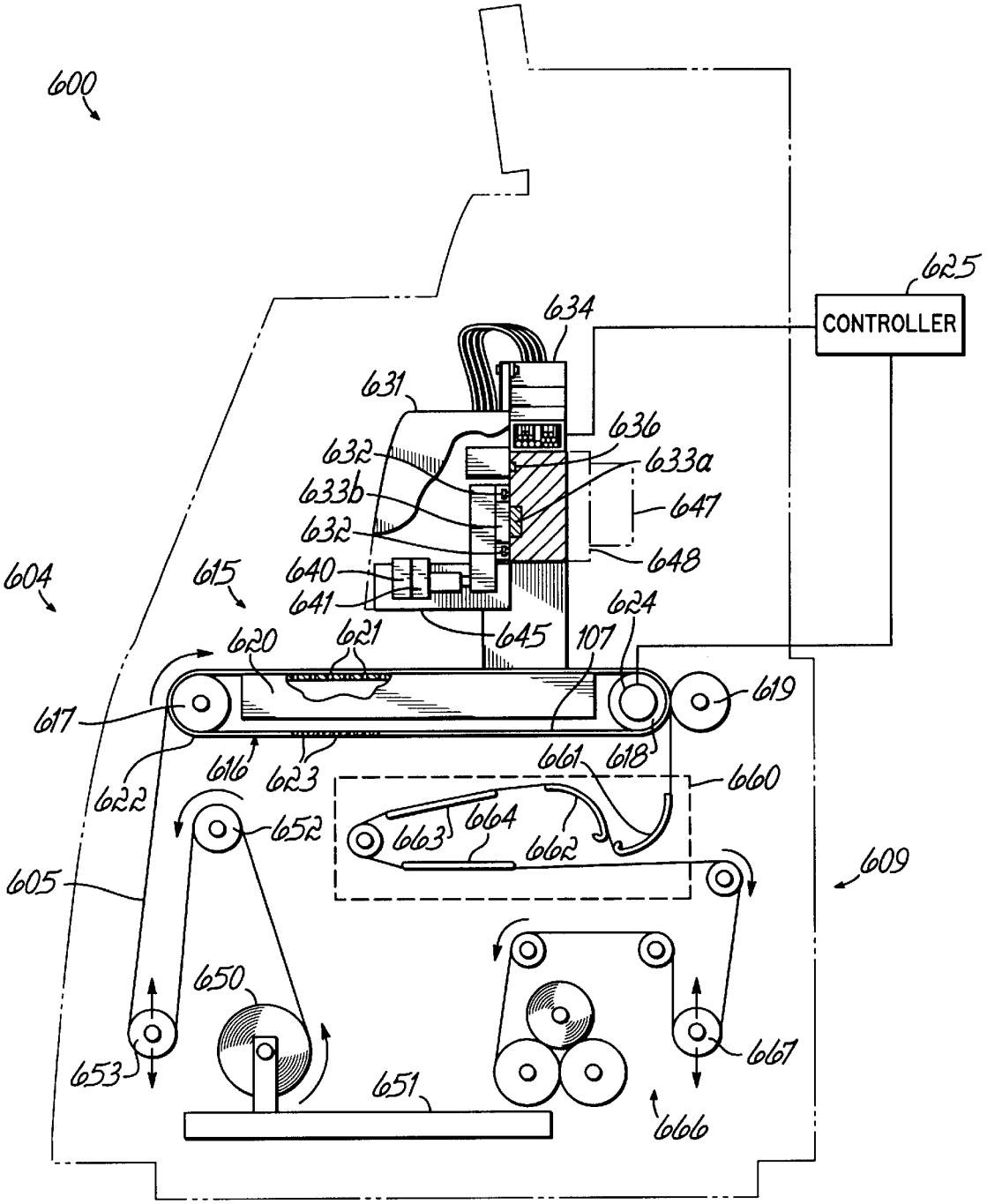
FIG. 3 is cross-sectional view of the printing machine of FIG. 2.
Figure 4:
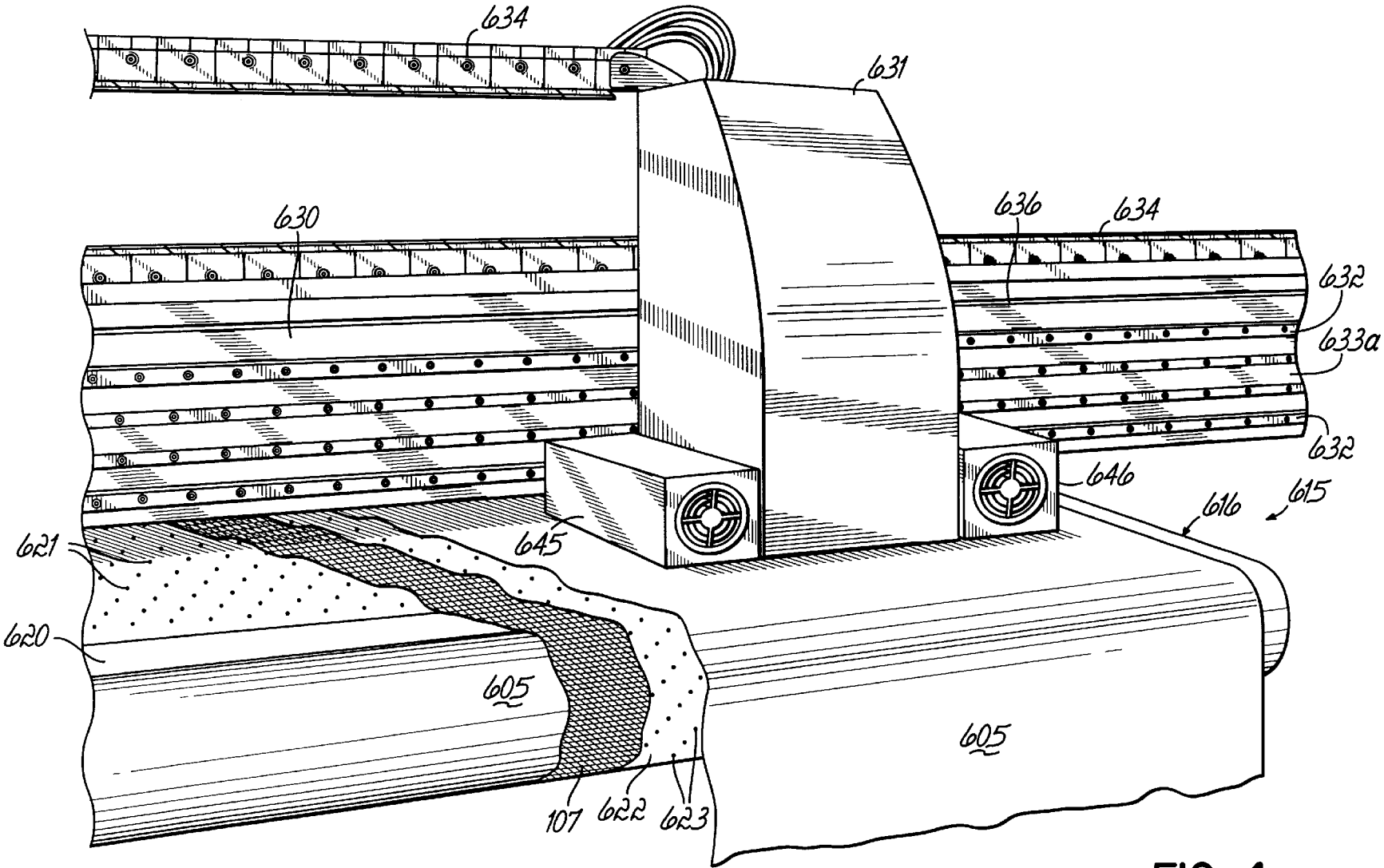
FIG. 4 is a perspective view of a portion of the machine of FIGS. 2 and 3.

The base 609 of the housing 601 has a conveyor table 615 on the top thereof on the upwardly facing horizontal surface of which is supported a length of the substrate web 605 for printing, as illustrated in FIGS. 3 and 4. The conveyor table 615 has a conveyor belt 616 that extends transversely across the width of the table 615 on transversely extending rollers 617 and 618 that are respectively rotatably mounted at the front and back of the base 609 of the housing 601. The belt 616 extends across the width of the frame 601 and rests on a smooth stainless steel vacuum table 620, which has therein an array of upwardly facing vacuum holes 621 which communicate with the underside of the belt 616. The belt 616 has a high friction rubber-like polymeric surface 622 to help prevent a horizontal sliding of the substrate 605 and through which an array of holes 623 is provided to facilitate communication of the vacuum from the vacuum table 620 to the substrate 605. The belt 616 is inelastic and has an open weave backing 107 which provides dimensional stability to the belt 616 while allowing the vacuum to be communicated between the holes 621 of the vacuum table 620 and the holes 623 in the surface 622 of the belt 616. The forward motion of the substrate 605 relative to the on the housing 601 is precisely controllable by indexing of the belt 616 by control of a DC brushless servo drive motor 624 (FIG. 3) for the rollers 617,618 with signals from a controller 625 behind the operator panel 606 on the housing 601. The indexing of the belt 616 is controllable to an accuracy of about 0.0005 inches to move the substrate web 605 relative to the housing 601.

Fixed to the base 609 of the housing 601 and extending transversely thereof is a printing bridge 630, above the conveyor table 615 and below the information bridge 610. The printing bridge 630 supports a print head carriage 631 for transverse movement above and parallel to the substrate 605 supported on the conveyor table 615, as illustrated in more detail in FIGS. 3 and 4. The bridge 630 has a pair of rails 632 on the front side thereof on which the carriage 631 is adapted to move. A linear servo motor 633 has a stator bar 633*a* containing a linear array of permanent magnets mounted across the front face of the printing bridge 630 and an armature 633*b* fixed to the carriage 631 and electrically connected through a wire cage chain 634 on the bridge 630 to the controller 625. An encoder 636 also extends across the front of the bridge 630 and provides feedback information to the controller 625 as to the position of the carriage 631 on the bridge 630. Linear motors such as the servo motor 633 are preferred because they are easier to tune, require little service, and have better acceleration and deceleration than belt or other drive systems. Because of their accuracy, printing can be carried out while the heads 640,641 are accelerating or decelerating, with programmed compensation in the timing of the jetting of the ink being made by the controller 625. This improves the speed and efficiency of the print operation by allowing the print heads 640,641 to use acceleration and deceleration time and to skip at high speed across areas of the substrate 605 that will have no printing and to areas at which ink is to be deposited, thereby minimizing the time during which the print head is not depositing ink on the substrate. Accordingly, linear servo motors to transversely move the carriage 631 that carries the print heads 640,641 across the bridge 630 are preferred for the machine 600.

Figure 5:
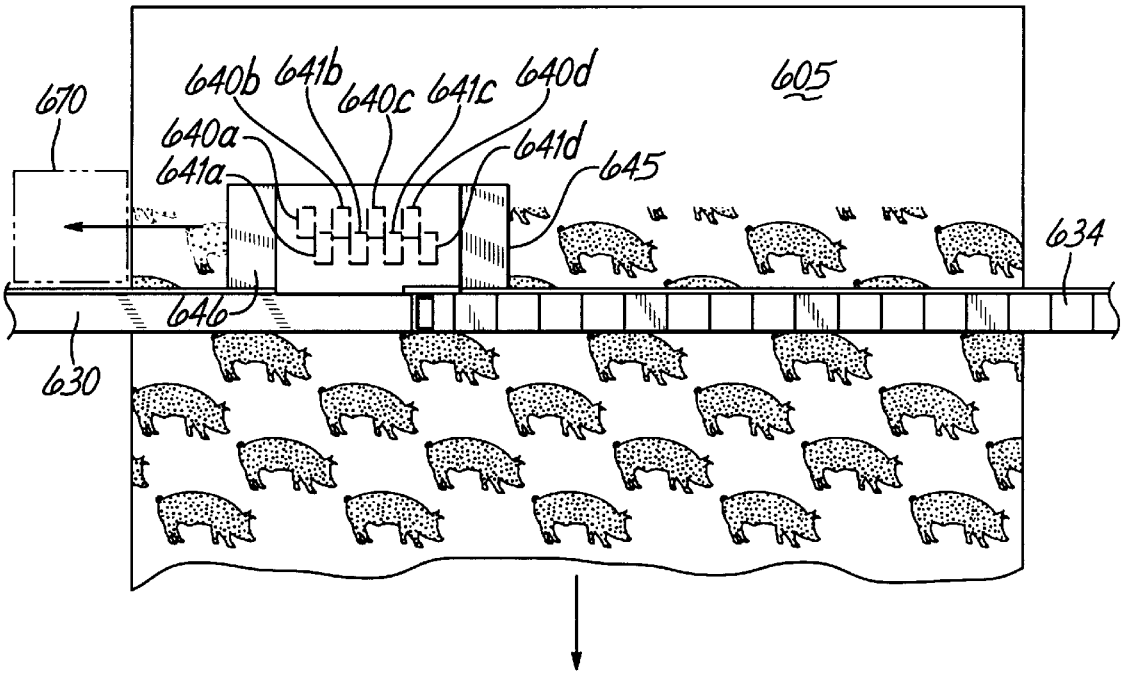
FIG. 5 is a top view of the portion of the machine illustrated in FIG. 4.
Figure 5A:
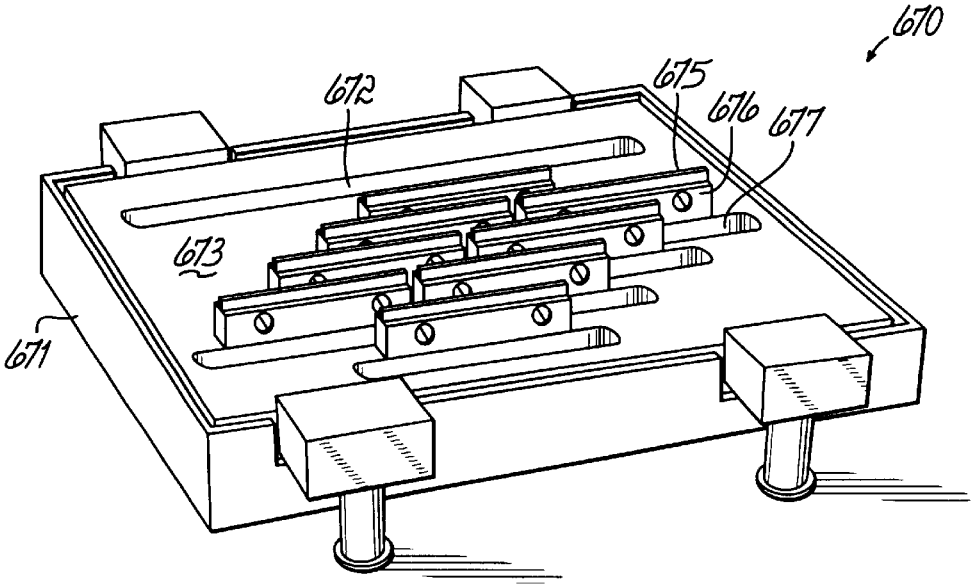
FIG. 5A is a perspective view of a portion of FIG. 5.

The print head carriage 631 has fixed at the bottom thereof two sets 640,641, each having four ink jet print heads 640*a–d*,641*a–d*. The print heads of each set are arranged in a transverse row so that they print successively along a transverse strip across the substrate 605 as the print head carriage 631 moves transversely across the bridge 630 to respectively apply the four colors of a CMYK color set. The ink jet printing heads 640*a–d*,641*a–d* each include a linear array of two hundred fifty-six (256) ink jet nozzles that extend in the longitudinal direction relative to the frame 601 and in a line perpendicular to the direction of travel of the carriage 631 on the bridge 630. The nozzles of each of the heads 640,641 are configured and controlled to simultaneously but selectively jet UV ink of one of the CMYK colors, and can print a strip of 256 pixels side by side across the substrate 605 at 15,000 dots per second. The spacing of the nozzles is, in the embodiment herein described, 90 jets per linear inch, so that the print heads are each slightly less than three inches wide. One pass of the print heads prints, for example, prints a transverse strip about 2.85 inches wide of ninety rows of pixels. With the two sets of heads 640 and 641, the strip is about 5.7 inches wide. By indexing the web 1/180th of an inch and printing with another pass of the carriage 631, which can be in the opposite direction, a longitudinal resolution of 180 dots per inch (dpi) can be achieved, as illustrated in FIG. 5. With four passes of the print heads, indexing between the scans 1/360th inch, a longitudinal dot resolution of 360 dpi can be achieved. Schemes to reduce artifacts and achieve different levels of printing quality involve activating half or one-third of the jets and scanning two or three times, indexing as required. Transverse resolution is settable at any resolution up to approximately 720 dpi by controlling the resolution and timing of the information sent by the controller 625 to the print heads. A transverse dot resolution is preferably maintained close to the longitudinal resolution being used.

Ink is supplied to each of the print heads 640*a–d*,641*a–d* by a respective one of a set of eight ink supplies (not shown) in the left side of the base 609 of the housing 601, which are connected to the respective heads through tubes carried by the wire cage 634. Each of the ink supplies includes a collapsible plastic bag and a peristaltic pump to supply UV ink to one of the ink jet print heads 640*a–d*,641*a–d*. Each collapsible supply bag is coupled to one of the peristaltic pumps via a tube that may include a quick disconnect. The peristaltic pump in turn supplies ink through a tube to a respective one of the ink jet print heads. An optional intervening reservoir may be provided in each tube between the pump and the print head to allow intermittent operation of the peristaltic pump or to handle intermittent demands exceeding pump output.

In the preferred and illustrated embodiment, the ink is ultraviolet light polymerizable ink composed essentially of polymerizable monomers which are stable unless and until exposed to a sufficient level of UV light to initiate a polymerizing reaction. UV light is provided by a pair of UV curing heads 645,646 mounted on each side of the carriage 631 to expose the ink immediately after it is deposited onto the substrate 605 by the print heads 640,641. The UV light heads 645,646 operate alternatively, with the head on the side of the carriage that trails the print heads 640,641 being activated to freeze the dots of ink within approximately 0.05 to 0.20 seconds after being deposited as the carriage 631 moves transversely on the bridge at approximately forty inches per second. The location of the heads 645,646 has the advantage of curing any atomized UV ink that might be produced by the nozzles of the print heads, thereby turning the liquid monomers into a dust that is less likely to be harmful. An optional additional UV light curing head 647 may be provided on a separate carriage 648 (as shown in phantom in FIG. 3) to move across the back of the bridge 630 independently of the movement of the print head carriage 631 to more thoroughly cure the ink by scanning the substrate 605 downstream of the print heads 640,641.

The supply of the substrate material 605 is loaded on a roll 650 onto a sliding carrier 651 that slides out of the base 609 of the housing 601 for loading and returns to the position shown in FIG. 3 for operation of the machine 600. The web of the material 605 extends from the roll 650 around an idler roller 652, around the bottom of a vertically moveable accumulator roller 653 and over the conveyor belt 616 on the top of the conveyor table 615. The accumulator roller 653 is weighted and supported by the web of material 605 so as to apply a uniform tension on the web of material 605. The ends of the shaft of the roller 653 ride in vertical tracks configured to keep the roller level. Limit switches or other detectors (not shown) sense upper and lower positions of the accumulator roller 653 so that the amount of material advancing from the supply roll 650 can be controlled. At the rear or downstream end of the conveyor table 615, a pinch roller 619 is provided to clamp the web 605 against the belt 616 as it passes around the roller 618.

Below the nip of rollers 618 and 619 is provided a heater 660. The web of material 605 enters the heater 660, which heats the substrate 605 to reduce the content of uncured monomers of the UV ink in the same manner as the heating station 26 described above in connection with the embodiment 10 of FIG. 1. Rather than using heated air, as in the case of heating station 26, the heater 660 contacts the substrate 605 with one or more heated platens, which quickly bring the substrate to a temperature of 360° F. within approximately one to two seconds. The heating station or heater 660 has a path therethrough of from about thirty inches to about forty inches for the web 605. The heater 660 includes an initial heated stainless steel bullnose platen 661 is positioned to contact the under surface of the material 605 opposite the side on which the ink from the print heads 640,641 has been deposited. The bullnose platen 661 brings the substrate 605 to a desired temperature of 300–380° in one to two seconds, where hot air takes from 30 seconds to 3 minutes. The web 605 passes over a second bullnose platen 662 downstream of the first platen 661, which contacts the ink bearing side of the substrate 605, insuring that the temperature of the substrate 605, and particularly the ink, is at the desired temperature throughout the thickness of the material 605. Once brought to temperature, the substrate 605 is maintained at the desired temperature by a series of additional plates 663,664. In lieu of the additional plates, other ways of maintaining the desired temperature for another thirty seconds more or less, such as with heated air or radiant heaters, would be adequate. An exhaust system (not shown) connects to the heater 660 to exhaust and dispose of any vapors that may contain monomers of the ink. Such exhaust may be connected to an electrostatic carbon filter and the air therefrom returned to the environment.

At the outlet of the heater 660 a series of rollers 666 take up and roll the printed material web 605. The series of rollers 666 includes another accumulator roller 667 which maintains tension on the web 605 downstream of the nip of the rollers 618,619.

As illustrated in FIG. 5, at the right side of the path of the print head carriage 631 is provided a head cleaning station 670. Periodically in the course of the printing of a web of material 605, for example, after the printing of some length of web, twenty meters for example, or whenever an operator determines that the heads need to be cleaned, the carriage 631 is traversed to the right side of the bridge 630 over the cleaning station 670. The cleaning station 670 is provided with a pan 671 for collecting ink. When the heads are moved to the cleaning station 670, they pass over a slot 672 in a wiper blade mounting block 673 and ink is jetted from the heads into the pan 671 to clear the heads. The cleaning station 670 is also provided with an array of longitudinally extending upwardly projecting polyurethane wiper blades 675 that are mounted to the block 673. The carriage 631 is operated to move on the bridge 630 to wipe the heads 640,641 back and forth over the wiper blades 675 to wipe the bottom faces thereof which house the nozzles free of excess ink or dust. The blades are made of a polymeric material such as polyurethane and held to the block 673 in slotted blade holder members 677 fixed to the top of the block 673. Slots 676 are provided in the block 673 so that ink wiped from the heads by the blades 675 drains into the collecting pan 671. Once the heads are cleaned, the carriage resumes the scanning and printing of the web 605. Such head cleaning is programmed to occur automatically, periodically during the printing process, when an automatic head cleaning option is selected by the operator.

Figure 6:
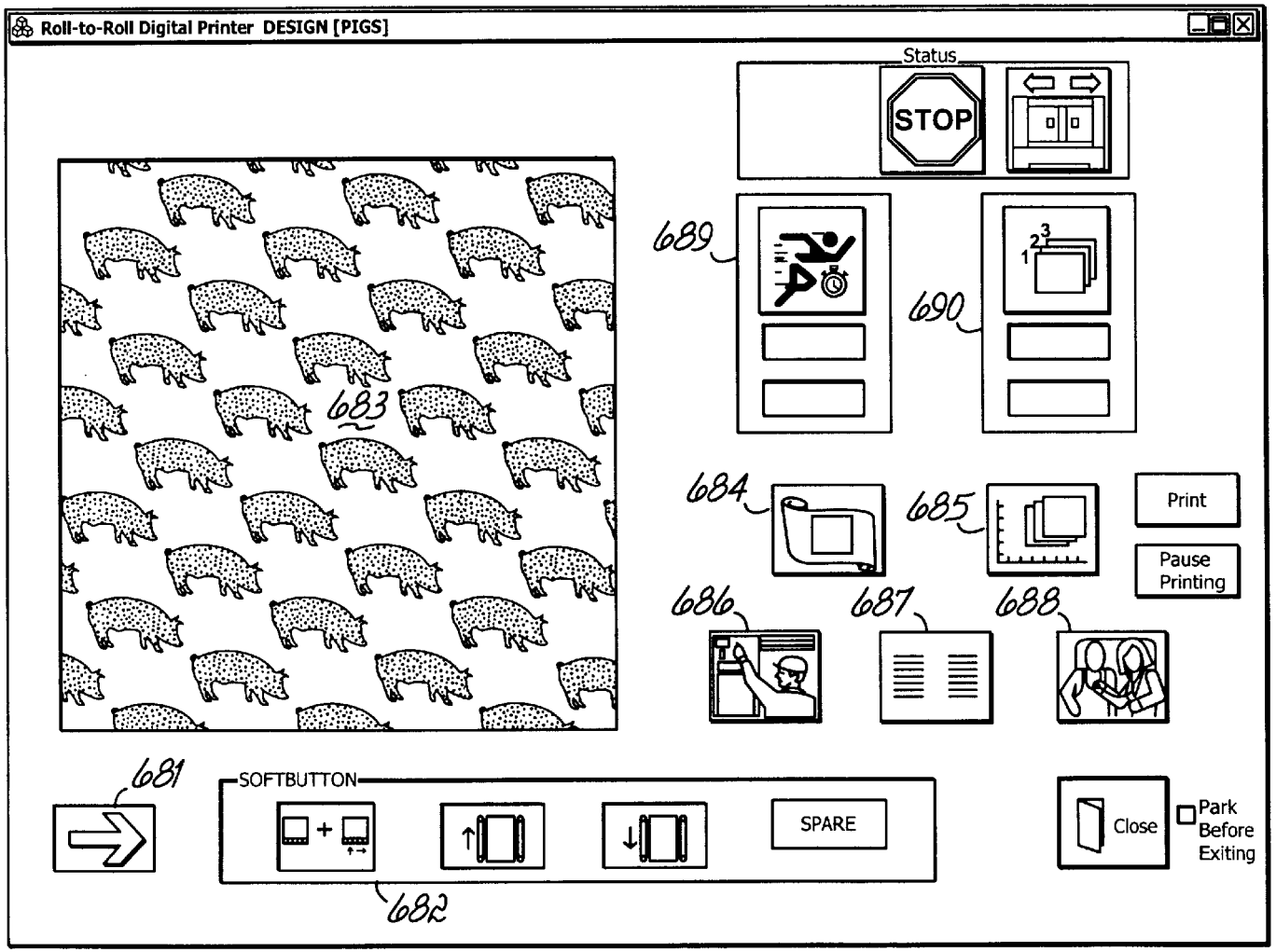
FIGS. 6 and 6A–6D are prints of display screens of the operator terminal and information bridge of the machine of FIG. 1.
Figure 6A:
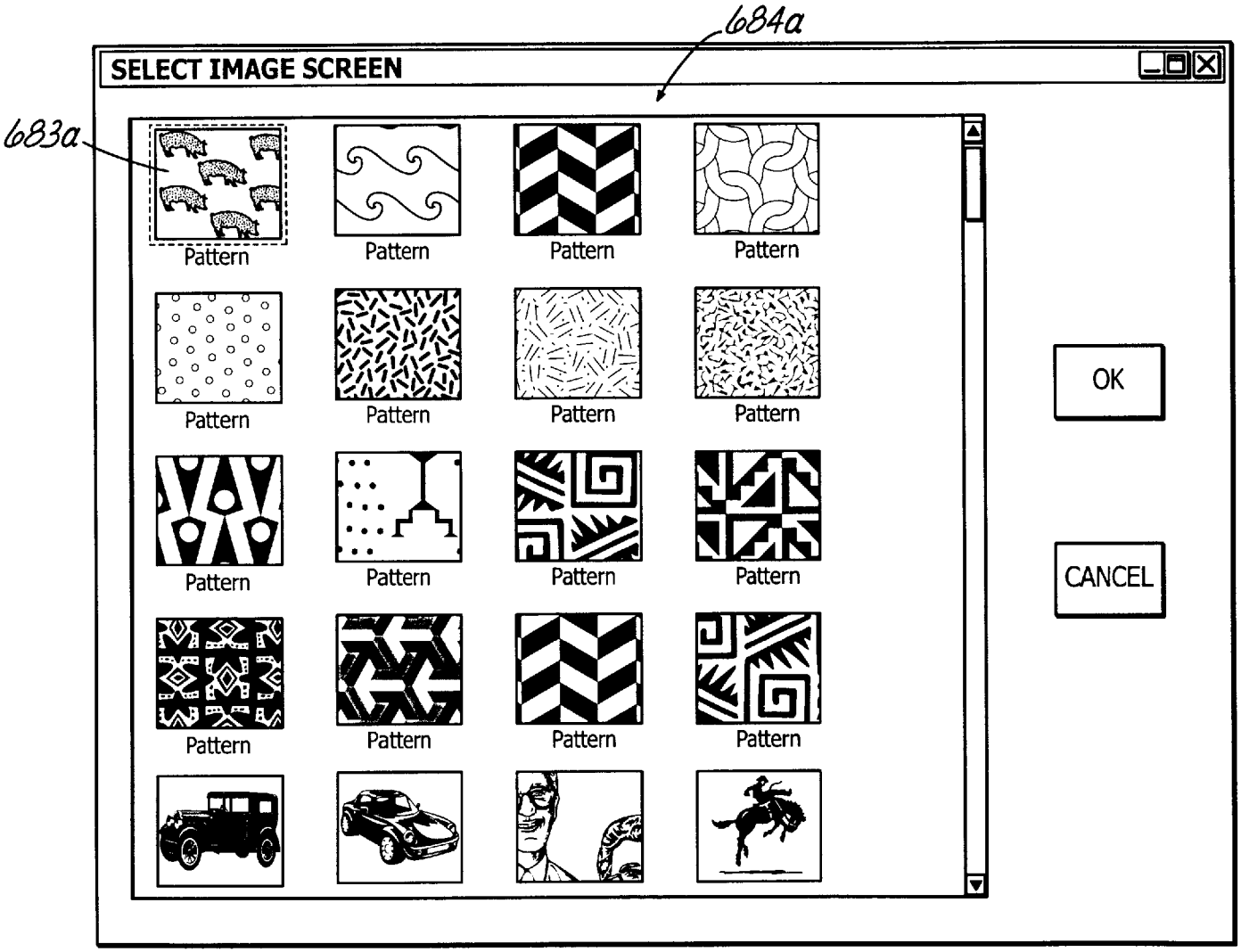
Figure 6B:
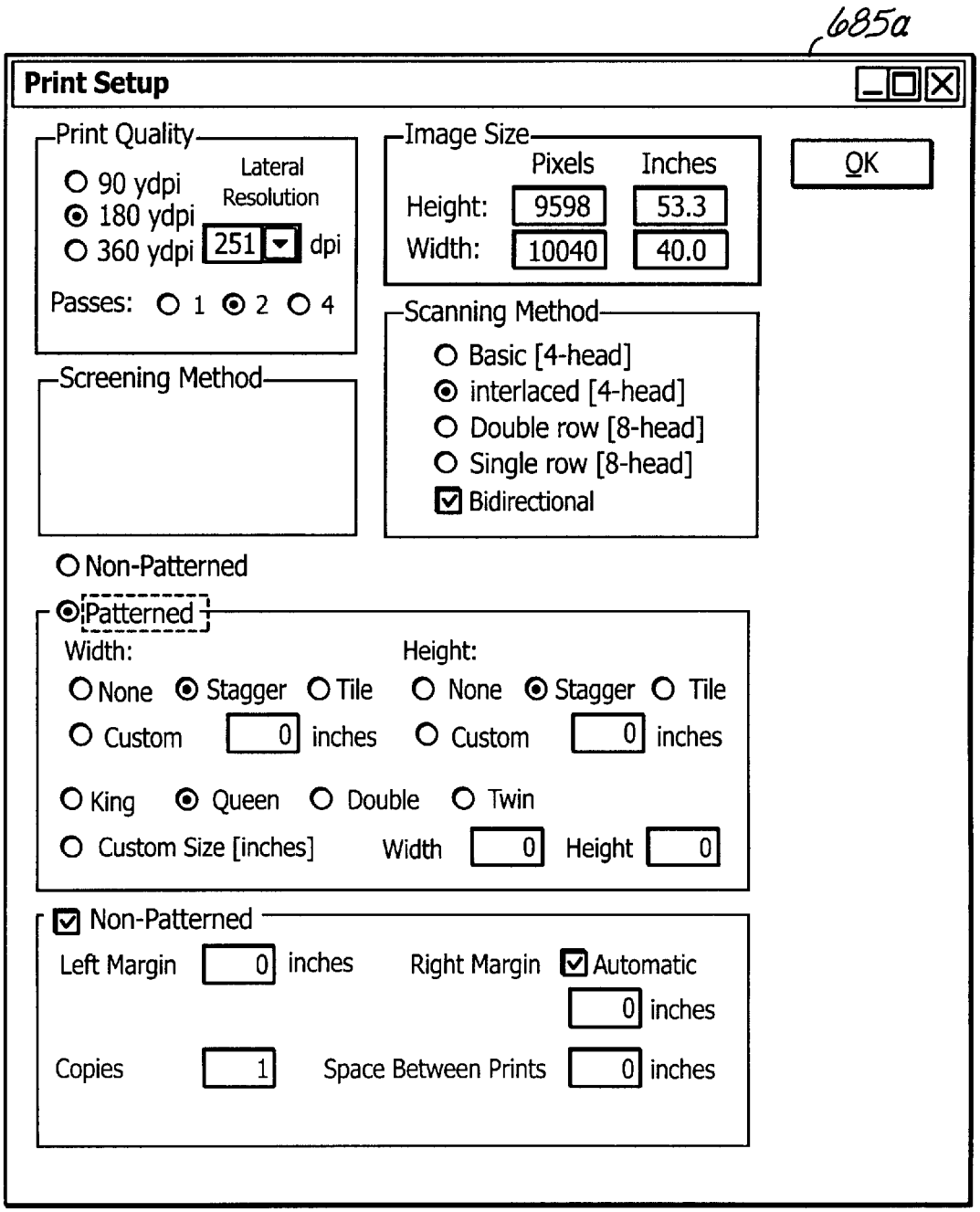
Figure 6C:
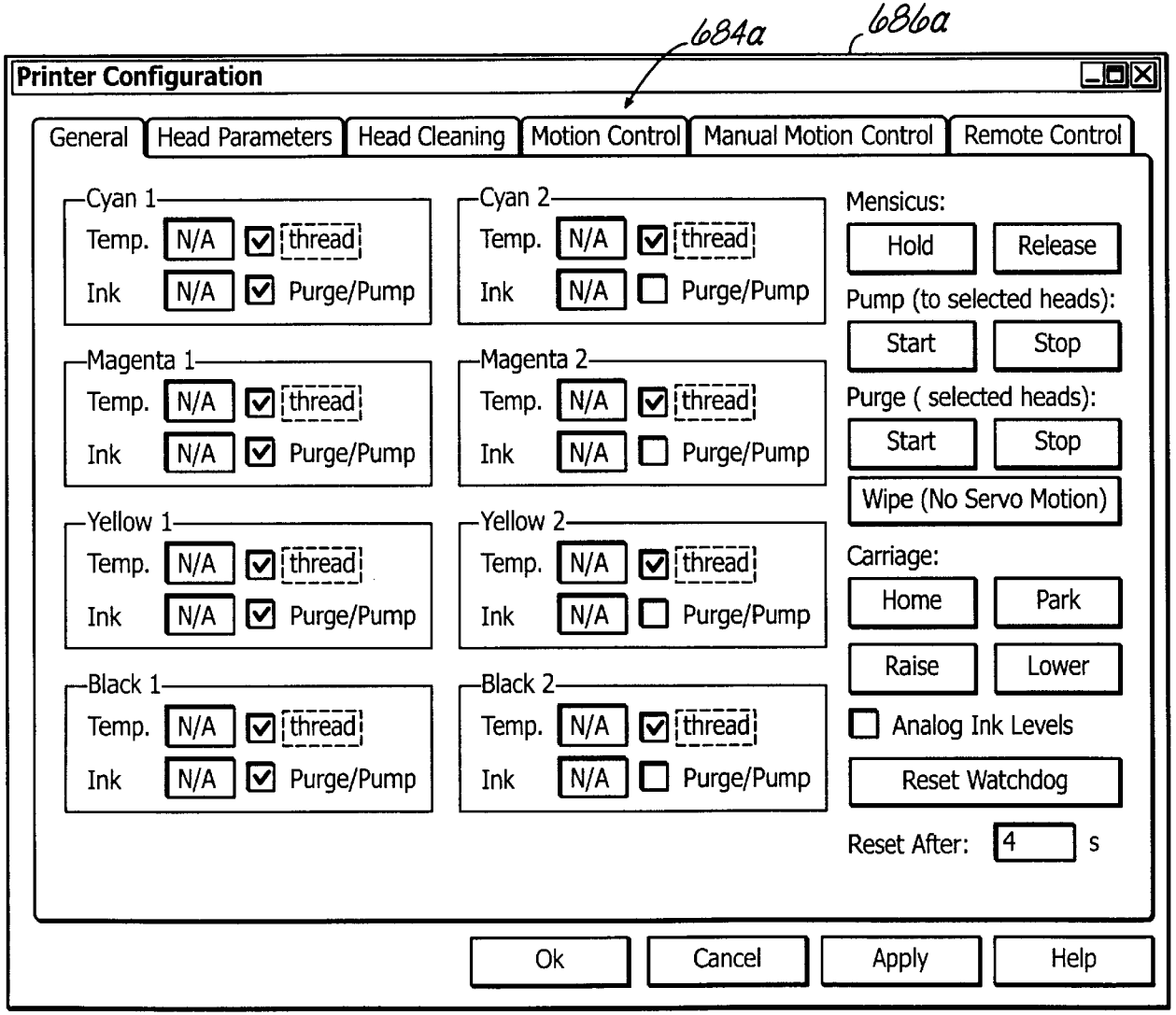
Figure 6D:
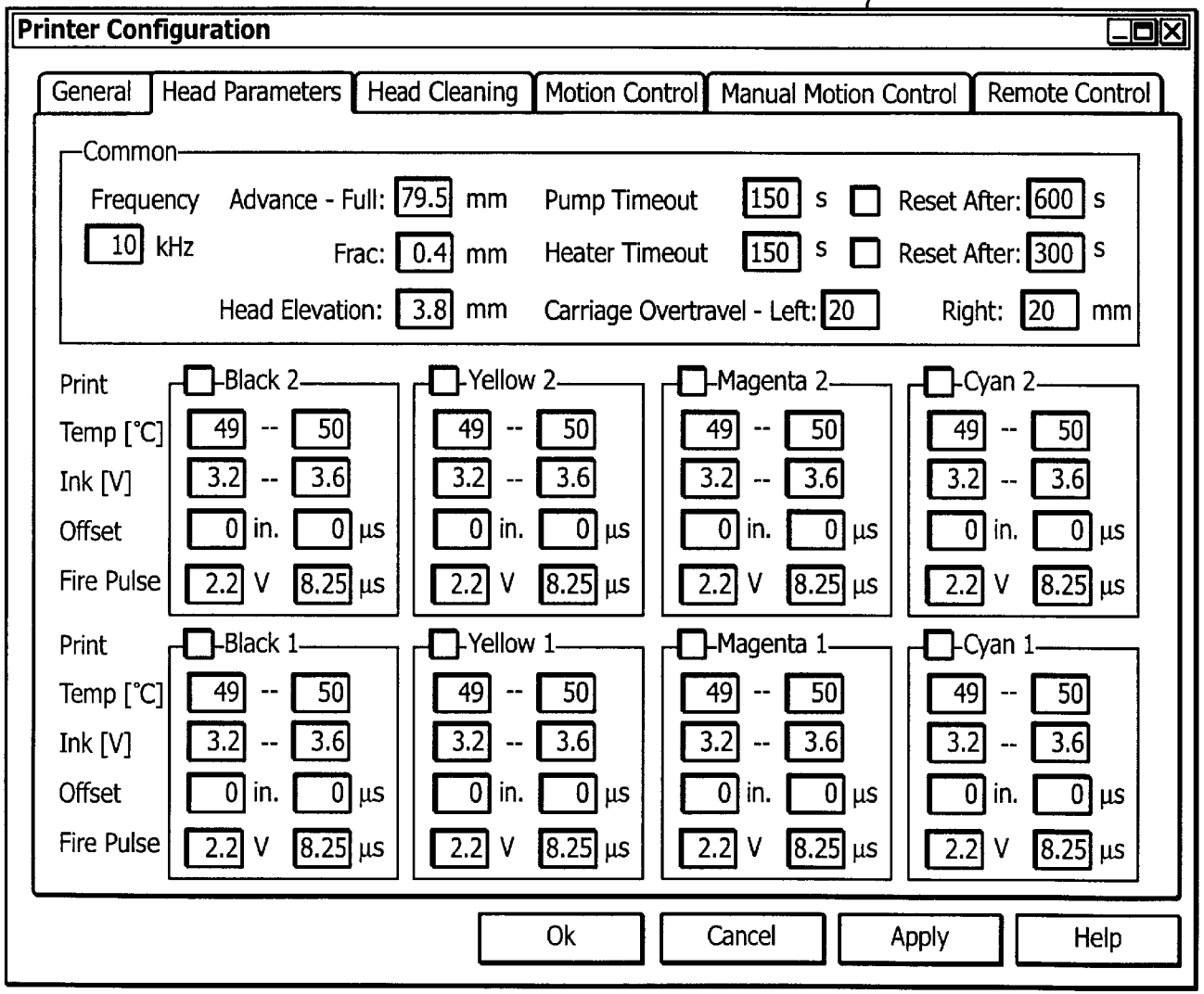

Operation of the machine 600 is carried out at the control panel 606 described above. FIG. 6 illustrates the main control window 680 displayed on the screen 608 of the panel 606. The window 680 includes a function key 681 and set of buttons 682 for assigning functions to the hard buttons 607 on the panel 606, such as manually advancing the web 605, moving the slide 651 to load a roll 650 and facilitating other such operator procedures, and for selecting the information to be displayed on the screens 611–614 on the information bridge 610. The operator can manually choose a selected pattern, which is displayed in window 683, by pressing the button 684, to open the pattern select window 684*a*, which displays icons 683*a* of the available patterns, as illustrated in FIG. 6A. The operator can also set up printer parameters by pressing the button 685 on window 680, which opens the printer setup window 685*a* illustrated in FIG. 6B. The operator can further configure the printer by pressing the button 686 on window 680, which opens the printer configuration window, various pages 686*a*,686*b* of which are illustrated in FIGS. 6C and 6D. Input, printed output and other communication functions can be controlled by pressing the button 687 while diagnostic information can be displayed by pressing the button 688. Speed and timing information is displayed in boxes 689 while batch and job status data, such as items and quantities completed and job (product or customer) identification data is displayed in boxes 690. The machine 600 is configured to function in accordance with the batch control and automatic scheduling processes described in U.S. Pat. No. 6,105,520, by James T. Frazer, Von Hall, Jr. and M. Burl White entitled Quilt Making Automatic Scheduling System and Method, hereby expressly incorporated by reference herein.

The above description is representative of certain embodiments of the invention. Those skilled in the art will appreciate that various changes and additions which may be made to the embodiments described above without departing from the principles of the present invention.

Therefore, the following is claimed:

1. A method of printing on fabric comprising the steps of:

jetting an ink composition containing a UV curable ink component and a dye component onto a fabric; then substantially curing at least the UV curable jetted ink component on the fabric by exposing the UV curable ink component to UV light, the curing resulting in a substantially cured UV ink component on the fabric containing uncured monomers of the UV curable ink and the dye component; then heating the fabric having the substantially cured UV cured ink component thereon and thereby reducing the level of the uncured monomers of the UV curable ink component on the fabric and affecting the dying of the fabric with the dye component.

2. A method of printing on textile comprising the steps of:

jetting onto a textile substrate a substance containing a UV curable component and a dye component; then substantially curing at least the UV curable jetted component on the substrate by exposing the UV curable component on the substrate to UV radiation; then heating the substance containing the substantially cured exposed UV component and the dye component on the substrate.

3. The method of claim 2 wherein:

the substance is a UV curable ink having a pigment contained and the dye component therein.

4. The method of claim 2 wherein:

the substantially cured UV curable component includes at least some uncured monomers and the heating of the substance includes reducing the amount of uncured monomers on the substrate.

5. The method of claim 2 wherein:

the heating includes contacting the substrate with a heated plate.

6. A printing method useful for printing on large area substrates comprising:

printing onto a substrate a dye contained in a substance that is stable until contacted with a curing medium;

at least partially curing of the substance on the substrate by applying the curing medium thereto; then heating the dye contained in the at least partially cured substance on the substrate to dye the substrate.

7. The method of claim 6 wherein:

printing includes jetting the substance having the dye contained therein onto the substrate.

8. The method of claim 6 wherein:

the substance is a UV curable ink having a pigment and the dye suspended therein.

9. The method of claim 6 wherein:

the at least partially cured substance includes at least some uncured monomers and the heating includes reducing the amount of uncured monomers on the substrate.

10. The method of claim 6 wherein:

the at least partial curing of the substance on the substrate includes freezing the substance on the substrate by applying the curing medium to the substance immediately upon the printing thereof to reduce the spread of the substance on the substrate.

11. The method of claim 6 wherein:

the at least partial curing of the substance on the substrate includes freezing the substance on the substrate by exposing the substance to UV light immediately upon the printing thereof onto the substrate to reduce the spread of the substance on the substrate.

12. The method of claim 6 wherein:

the heating includes contacting the substrate with a heated plate.

13. A method of printing onto a substrate comprising:

depositing a polymerizable substance containing a dye onto a substrate;

polymerizing the substance by initiating a polymerizing reaction in the substance and maintaining the reaction until the substance is substantially polymerized; then heating the substantially polymerized substance and the dye contained therein while on the substrate to affect the dying of the substrate.

14. The method of claim 13 wherein:

the depositing includes the jetting of the substance onto the substrate.

15. The method of claim 13 wherein:

the substance is a UV curable ink having a pigment contained therein.

16. The method of claim 13 wherein:

the substantially polymerized substance includes at least some unpolymerized monomers and the heating includes reducing the amount of unpolymerized monomers on the substrate.

17. The method of claim 13 wherein:

the heating includes contacting the substrate with a heated plate.

18. An ink jet printing method comprising:

jetting onto a substrate a curable liquid having a dye component contained therein; then substantially curing the liquid on the substrate; then heating the substantially cured liquid on the substrate so as to affect the dying of the substrate.

19. The method of claim 18 wherein:

the curable liquid is a UV curable polymer; and the curing of the liquid on the substrate includes exposing the UV curable component on the substrate to UV radiation.

20. An ink jet printing method comprising:

jetting onto a substrate a curable liquid polymer having dye suspended therein; then substantially curing the liquid polymer on the substrate to fix the position of the suspended dye on the substrate; then heating the substantially cured liquid polymer on the substrate to activate the dye and thereby affect the dying of the substrate.

21. The method of claim 20 wherein:

the dye is a sublimation dye; and the heating includes heating the dye to sublime the dye to dye the substrate.

22. The method of claim 20 wherein:

the curable liquid polymer is a UV curable substance;

the dye is a sublimation dye;

the curing includes exposing the substance to UV light a sufficiently short time after jetting the substance onto the substrate to at least partially prevent a spreading of the polymer on the substrate; and the heating includes heating the dye to sublime the dye.

* * * * *